US009259893B1

(12) United States Patent
Wu

(10) Patent No.: US 9,259,893 B1
(45) Date of Patent: Feb. 16, 2016

(54) HIGH-SPEED ELECTRIC-HEATING TEMPERATURE-CONTROL SINGLE CORRUGATING MACHINE

(71) Applicant: Huizhou Long Ji Machinery Co., Ltd., Huizhou, Guangdong (CN)

(72) Inventor: Zhiyong Wu, Guangdong (CN)

(73) Assignee: HUIZHOU LONG JI MACHINERY CO., LTD., Huizhou, Guangdong (CN)

( * ) Notice: Subject to any disclaimer, the term of this patent is extended or adjusted under 35 U.S.C. 154(b) by 0 days.

(21) Appl. No.: 14/474,215

(22) Filed: Sep. 1, 2014

(51) Int. Cl.
*B31F 1/28* (2006.01)

(52) U.S. Cl.
CPC . *B31F 1/28* (2013.01); *B31F 1/285* (2013.01); *B31F 1/289* (2013.01)

(58) Field of Classification Search
None
See application file for complete search history.

(56) References Cited

U.S. PATENT DOCUMENTS

| | | | | |
|---|---|---|---|---|
| 4,589,944 | A * | 5/1986 | Torti | B31F 1/285 156/359 |
| 5,897,824 | A * | 4/1999 | Marschke | G31F 1/285 156/205 |
| 2014/0048526 | A1* | 2/2014 | Hung | B31F 1/285 219/385 |

* cited by examiner

*Primary Examiner* — Barbara J Musser
(74) *Attorney, Agent, or Firm* — Jackson IPG PLLC; Demian K. Jackson

(57) ABSTRACT

A high-speed electric-heating temperature-control single corrugating machine comprises a first paper conveying roller, an upper corrugating roller and a lower corrugating roller, a glue pasting roller is configured to paste glue on the corrugated core paper, a pressure roller is configured to bond the corrugated core paper pasted with glue with base paper to form corrugated paper, a second paper conveying roller is configured to convey the corrugated paper out, a third paper conveying roller is configured to convey the base paper to the upper corrugating roller, a first heating device is configured to heat the corrugated paper, a second heating device is configured to heat the base paper, a first infrared heating device is configured to heat the core paper passing through the upper corrugating roller and a second infrared heating device is configured to heat the upper corrugating roller are arranged.

4 Claims, 1 Drawing Sheet

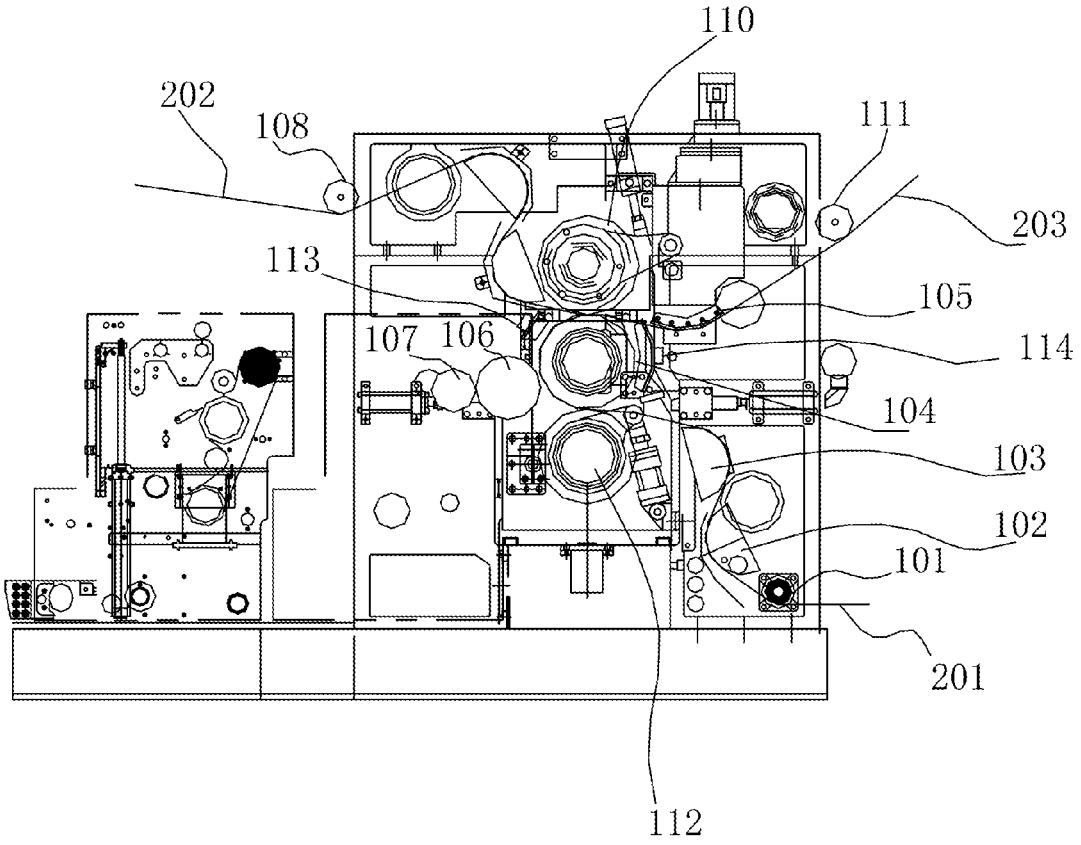
110
202
108
111
203
113
105
107
106
114
104
103
102
101
201
112

HIGH-SPEED ELECTRIC-HEATING TEMPERATURE-CONTROL SINGLE CORRUGATING MACHINE

FIELD OF THE INVENTION

The invention relates to the technical field of packaging machinery, in particular to a high-speed electric-heating temperature-control single corrugating machine.

BACKGROUND OF THE INVENTION

In a single corrugating machine provided by the prior art, a steam boiler is used for generating steam; a steam pipe is connected with a preheating cylinder or a forge furnace; the steam is used for raising the temperature; before base paper enters the single corrugating machine, a preheating cylinder with a diameter of 1,000 mm is configured to heat the base paper; before corrugated paper enters the single corrugating machine, a preheating cylinder with a diameter of 1,000 mm is configured to heat the corrugated paper; and the single corrugating machine is provided with 0 to 2 preheating cylinders with a diameter of 500 mm, which are configured to heat the base paper and the corrugated paper respectively, one pressure furnace, two corrugating rollers and three forge rollers, wherein the pressure furnace and the corrugating rollers are both configured to heat the corrugated paper. The existing single corrugating machine has the defects of high heat dissipation, low heat efficiency, complex and heavy mechanism and high cost. Moreover, the existing single corrugating machine is high in air pollution and low in product quality.

SUMMARY OF THE INVENTION

The invention provides a high-speed electric-heating temperature-control single corrugating machine, which is low in heat dissipation, high in heat efficiency, simple in mechanism, light in weight and low in cost. Moreover, the high-speed electric-heating temperature-control single corrugating machine is high in product quality and zero in air pollution, and can reduce the temperature of operation environment greatly and improve the comfort of an operator.

For this end, the invention provides the following technical solution:

A high-speed electric-heating temperature-control single corrugating machine includes: a first paper conveying roller configured to convey core paper to an upper corrugating roller, the upper corrugating roller and a lower corrugating roller which are configured to mould the core paper to form corrugated core paper, a glue pasting roller configured to paste glue on the corrugated core paper, a pressure roller configured to bond the corrugated core paper pasted with glue with base paper to form corrugated paper, a second paper conveying roller configured to convey the corrugated paper out, a third paper conveying roller configured to convey the base paper to the upper corrugating roller, a first heating device configured to heat the corrugated paper, a second heating device configured to heat the base paper, a first infrared heating device configured to heat the core paper passing through the upper corrugating roller and a second infrared heating device configured to heat the upper corrugating roller are arranged, wherein a third heating device which is configured to heat the core paper is arranged between the first paper conveying roller and the glue pasting roller; the pressure roller is arranged on one side of the upper corrugating roller; a lower corrugating roller is further arranged on the lower side of the upper corrugating roller; and the first, the second and the third paper conveying rollers, the glue pasting roller, the pressure roller and the lower corrugating roller are connected with a power unit in a driving way respectively.

Preferably, a scratching roller is further arranged on one side of the glue pasting roller and is connected with a power unit in a driving way.

Preferably, both the first and the second heating devices are infrared heating devices.

Preferably, a fourth heating device for heating the core paper is further arranged between the third heating device and the upper corrugating roller.

Preferably, both the third and the fourth heating devices are arc ceramic heaters.

Through the technical solution, the invention has the following advantages: in the high-speed electric-heating temperature-control single corrugating machine provided by the invention, the infrared heating device is adopted to heat the outside of the corrugating roller (which can reduce the thermal expansion of the roller) and to directly heat the paper, so as to achieve a lower heat dissipation and a higher heat efficiency with respect to steam heating. Furthermore, because such device as the infrared heating device is adopted for heating, the whole single corrugating machine is simpler and lighter in mechanism, lower in cost and higher in product quality; and with respect to the steam heating, the temperature of the operation environment can be further reduced greatly and more comfort is brought to the operator.

BRIEF DESCRIPTION OF THE DRAWINGS

FIG. 1 is a diagram showing the structure of a high-speed electric-heating temperature-control single corrugating machine provided by the invention.

DETAILED DESCRIPTION OF THE PREFERRED EMBODIMENTS

In order to understand the technical solution of the invention better, the embodiment provided by the invention is described below in combination with the drawing.

An embodiment of the invention provides a high-speed electric-heating temperature-control single corrugating machine, as shown in FIG. 1, including: a first paper conveying roller 101 configured to convey core paper 201 to an upper corrugating roller 104, the upper corrugating roller 104 and a lower corrugating roller 112 which are configured to mould the core paper 201 to form corrugated core paper, a glue pasting roller 106 configured to paste glue to the corrugated core paper, a pressure roller 110 configured to bond the corrugated core paper pasted with glue with base paper to form corrugated paper 203, a second paper conveying roller 111 configured to convey the corrugated paper 203 out, a third paper conveying roller 108 configured to convey the base paper 202 to the upper corrugating roller 104, a first heating device 105 configured to heat the corrugated paper 203, a second heating device 109 configured to heat the base paper 202, a first infrared heating device 113 configured to heat the core paper 201 passing through the upper corrugating roller 104 and a second infrared heating device 114 configured to heat the upper corrugating roller 104 are arranged, wherein a third heating device 102 configured to heat the core paper 201 is arranged between the first paper conveying roller 101 and the glue pasting roller 106; the pressure roller 110 is arranged on one side of the upper corrugating roller 104; a lower corrugating roller 112 is further arranged on the lower side of the upper corrugating roller 104; the first, the second and the third paper conveying rollers 101, 111, 108, the glue pasting roller 106, the pressure roller 110 and the lower corrugating roller 112 are connected with a power unit in a driving way respectively; and there may be one power unit or multiple power units corresponding to the first, the second and the third paper conveying rollers 101, 111, 108, the glue pasting roller 106, the pressure roller 110 and the lower corrugating roller 112 respectively, so that the first, the second and the third paper conveying rollers 101, 111, 108, the glue pasting roller 106 and the pressure roller 110 are driven respectively. The second heating device 109 is configured to heat the pressure roller 110 so as to heat the base paper 202.

The second infrared heating device 114 heats the upper corrugating roller for heat preservation, so that the upper corrugating roller can preserve the heat when the core paper 201 passes through the upper corrugating roller.

The first infrared heating device 113 directly heats the core paper passing through the upper corrugating roller according to the production requirement.

A corrugating line pressure furnace and a corrugating roller provided by the prior art, which need steam for heating, are both a pressure container and are relatively high in heat dissipation; and in the driving process, the forge furnace is curved due to thermal expansion, so as to lose dynamic balance and vibrate. Therefore, the physical property of a paper board may be damaged due to the vibration in the feeding process of paper. The single corrugating machine provided by the embodiment may not damage the physical property of paper easily, and the processed paper is high in quality.

The core paper is driven by the first paper conveying roller and is heated by the arc ceramic heating devices to enter the upper and the lower corrugating rollers; the upper and the lower corrugating rollers are provided with wavy ridges for forming the core paper into corrugated paper; the scratching roller uniformly distributes the glue on the glue pasting roller; the formed core paper is glued and is then bonded with the base paper so as to enter into the space between the pressure roller and the upper corrugating roller to be compressed and bonded; and finally, the obtained product is heated by the infrared heating devices to enter into the next processing link.

In other embodiments, based on the embodiment above, furthermore, the scratching roller 107 is further arranged on one side of the glue pasting roller 106 and is configured to scratch the glue or the paste on the base paper 202 pasted with glue by the pasting roller 106. The scratching roller 107 is connected with a power unit in a driving way. The power unit may be the same one in the embodiment above or be a separate one corresponding to the scratching roller 107.

Based on the embodiment, preferably, both the first and the second heating devices 105 and 109 are infrared heating devices. The infrared heating devices adjust the heating efficiency in an automatic control way according to the detected paper temperature, so as to heat the paper to the set temperature. The infrared heating devices can adjust the infrared heating width according to the paper feeding width, so as to reduce the unnecessary heating.

In other embodiments, based on the embodiment above, furthermore, a fourth heating device 103 for heating the core paper 201 is further arranged between the third heating device 102 and the upper corrugating roller 104.

In the embodiments above, preferably, both the third heating device 102 and the fourth heating device 103 are arc ceramic heaters, and the surface temperature of the arc ceramic heater is set individually and keeps constant according to the speed of a vehicle. After the core paper is heated by an electric-heating arc ceramic heater, because the temperature of the core paper cannot reach the set temperature due to the high speed, the infrared heating device as the first heating device 105 may heat it for compensation, and the heating width may be set according to the width of the vehicle, so as to heat the corrugated paper 203 better. The arc ceramic heater has a smaller surface area than that of a preheating cylinder and a conventional forge furnace, therefore, the heat dissipation of the device is reduced and the heat efficiency is improved. As a heating device, the arc ceramic heater has the advantages of excellent thermal conductivity and uniform distribution of heat surface temperature. In case of startup, there is no breakthrough current and the temperature can keep constant. 30% of electricity consumption can be reduced due to the heat preservation performance. No boiler and steam pipe is needed, so as to reduce the environment pollution and energy consumption.

The above describes a high-speed electric-heating temperature-control single corrugating machine provided by the embodiments of the invention in detail. For those skilled in the art, some modifications may be made to the specific implementation way and the application range according to the concept of the embodiments of the invention. In conclusion, the contents of the specification shall not be regarded as limit to the invention.

What is claimed is:

1. A high-speed electric-heating temperature-control single corrugating machine, comprising: a first paper conveying roller configured to convey core paper to an upper corrugating roller, the upper corrugating roller and a lower corrugating roller which are configured to mould the core paper to form corrugated core paper, a glue pasting roller configured to paste glue on the corrugated core paper, a pressure roller configured to bond the corrugated core paper pasted with glue with base paper to form corrugated paper, a second paper conveying roller configured to convey the corrugated paper out, a third paper conveying roller configured to convey the base paper to the upper corrugating roller, a first heating device configured to heat the corrugated paper, a second heating device configured to heat the base paper, a first infrared heating device configured to heat the core paper passing through the upper corrugating roller and a second infrared heating device configured to heat the upper corrugating roller are arranged, wherein a third heating device which is configured to heat the core paper is arranged between the first paper conveying roller and the glue pasting roller; the pressure roller is arranged on one side of the upper corrugating roller; a lower corrugating roller is further arranged on the lower side of the upper corrugating roller; and the first, the second and the third paper conveying rollers, the glue pasting roller, the pressure roller and the lower corrugating roller are connected with a power unit in a driving way respectively.

2. The high-speed electric-heating temperature-control single corrugating machine according to claim 1, wherein both the first and the second heating devices are infrared heating devices.

3. The high-speed electric-heating temperature-control single corrugating machine according to claim 1, wherein a fourth heating device for heating the core paper is further arranged between the third heating device and the upper corrugating roller.

4. The high-speed electric-heating temperature-control single corrugating machine according to claim 3, wherein both the third and the fourth heating devices are arc ceramic heaters.

* * * * *